United States Patent [19]

Peck

[11] Patent Number: 4,871,265

[45] Date of Patent: Oct. 3, 1989

[54] RESEALABLE BAG

[75] Inventor: James M. Peck, St. Paul, Minn.

[73] Assignee: Minnesota Mining & Manufacturing Company, St. Paul, Minn.

[21] Appl. No.: 195,211

[22] Filed: May 18, 1988

[51] Int. Cl.[4] ..... B65D 33/16

[52] U.S. Cl. ..... 383/89; 383/86; 229/80

[58] Field of Search ..... 383/86, 89; 229/80

[56] References Cited

U.S. PATENT DOCUMENTS

| | | | |
|---|---|---|---|
| 3,325,084 | 6/1967 | Ausnit | 383/86 X |
| 4,323,189 | 4/1982 | Regenstein, Jr. | 383/89 |
| 4,441,613 | 4/1984 | Hain et al. | 383/86 X |
| 4,543,139 | 9/1985 | Freedman et al. | 383/86 X |
| 4,584,201 | 4/1988 | Boston | 426/106 |
| 4,690,322 | 9/1987 | Burns | 383/86 X |
| 4,706,297 | 11/1987 | Ausnit | 383/89 X |

FOREIGN PATENT DOCUMENTS 2070564 9/1981 United Kingdom .

OTHER PUBLICATIONS

Advertisement, Babbitt Weekly Newspaper, Babbitt, Minnesota, published May 18, 1987.

*Primary Examiner*—Stephen Marcus
*Assistant Examiner*—Nova Stucker
*Attorney, Agent, or Firm*—Merchant, Gould, Smith, Edell, Welter & Schmidt

[57] ABSTRACT

A closure system which reseals an opened bag. The closure system includes a pressure sensitive adhesive on the front side and a defined release surface on the back side of the bag. The top portion of the bag is folded so that the defined release surface comes into contact with the adhesive thereby resealing the opened bag.

11 Claims, 2 Drawing Sheets

RESEALABLE BAG

FIELD OF THE INVENTION

The present invention is directed to bags of a type including a resealing feature for use once the bag is opened.

BACKGROUND OF THE INVENTION

Products which are packaged to have multiple servings or more than one useful quantity, such as dog food, are commonly packaged in a bag. The bag is opened, and a quantity of the product is removed. A large quantity of product, however, remains in the bag. It is desirable to reclose the bag so as not to spill remaining product and also to help maintain the quality of the remaining product. Devices for reclosing bags have appeared and include wire ties, mechanical clips or clamps, tape tabs, resealable adhesive strips which serve as the initial seal on the package, etc. More relevantly, U.S. Pat. No. 4,584,201 shows a flexible package wherein a double sided tape is attached transversely to one side of the package and after opening, the opened end of the package is folded twice so that a portion of the side of the package opposite the tape contacts the tape to reseal the package. It is critical to the successful functioning of the closure system that the package be made of a material which would adhere properly to the tape. From manufacturing and marketing points of view, it is less than desirable for the adhesive of the closure system to force the type of material which must be used for the bag used to package the product. In any case, this type of closure system would not provide repeatable closures for a paper bag. The closure system would result in tearing or delaminating of a bag made of paper.

Additionally, British Publication No. 2,070,564A shows a bag having a contact adhesive applied near the top of the back side of the bag and another contact adhesive applied to a location spaced downwardly from the top of the bag so that after two folds the two contact adhesives come together to close the bag. Contact adhesives stick to one another, but not to other surfaces. They are easily soiled and do not have nearly the repeatability of pressure-sensitive adhesives.

SUMMARY OF THE INVENTION

The present invention is directed to a resealable bag wherein a pressure-sensitive adhesive always contacts a specific defined release surface thereby providing repeatable closures of a well defined performance level.

In a preferred embodiment, the bag includes an enclosure having a mechanism for opening the top. The enclosure also has a first receiving location on the front and a second receiving location on the back. A pressure-sensitive adhesive is present at one of the first and second receiving locations. A mechanism for forming a defined release surface is present at the other of the first and second receiving locations. The enclosure is foldable so that the surface forming mechanism contacts the pressure-sensitive adhesive when reclosing the enclosure after it has been opened. The adhesive has characteristics of bonding to both the enclosure and the surface forming mechanism and in tension releasing the surface forming mechanism before releasing the enclosure. In this way, the adhesive remains on the enclosure when the surface forming mechanism separates therefrom during a reopening movement. A release liner is used to cover the adhesive before the bag is initially opened.

The pressure-sensitive adhesive can be the exposed adhesive of a double coated tape, a pressure sensitive adhesive which remains on the enclosure after the liner of an adhesive transfer tape has been removed, or a pressure sensitive adhesive which is coated or directly applied to the bag.

The surface forming mechanism may be a single sided tape having an exposed side with a preselected adhesion release surface. Alternatively, a material with a desired adhesion release surface can be coated or applied directly on the bag.

The present resealing system is particularly advantageous since it can be independently selected and applied to a bag made of paper or even other materials.

DETAILED DESCRIPTION OF THE PREFERRED EMBODIMENTS

Figure 1:
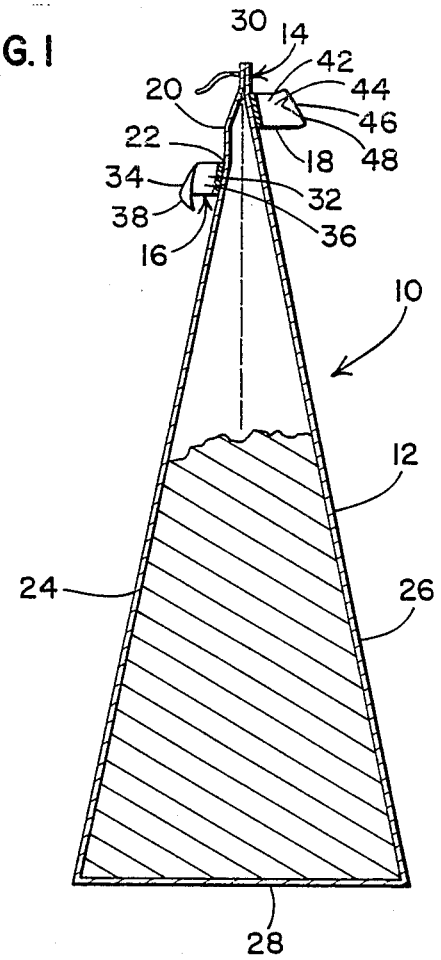
FIG. 1 is a cross-sectional view of a bag in accordance with the present invention.

Referring now to the drawings wherein like reference numerals designate identical or corresponding parts throughout the several views, and more particularly to FIG. 1, a resealable bag in accordance with the present invention is designated generally by the numeral 10. Bag 10 includes an enclosure 12 having an opening mechanism 14. Bag 10 also includes a double sided tape 16 and a strip 18 on the side of enclosure 12 opposite tape 16. Strip 18 provides a defined release surface so that after enclosure 12 is opened with opening mechanism 14, it may be folded at creased or scored lines 20 and 22 to allow the defined release surface of strip 18 to contact the exposed adhesive of tape 16 thereby reclosing and resealing enclosure 12.

Enclosure 12 is preferably made of a paper material, usually of several plies, with the outer surface often coated or at least imprinted. The paper material can be any of several grades, and the coating or printing can be applied uniformly or intermittently and provide a surface of various roughness or smoothness. It is understood that enclosure 12 could also be made of non-paper materials. The resealable system is not limited by the material of the enclosure.

Enclosure 12 has opposite substantially flat front and back sides 24 and 26 joined at side edges and a bottom edge, in some cases, or joined at a bottom 28 as shown. Enclosure 12 also has a top portion 30. It is understood that a particular design of enclosure 12 is shown in the Figures, but that many other designs are also appropriate.

An opening mechanism 14 is formed at top 30. The opening mechanism can assume any of a variety of designs. As shown in FIG. 1, the opposite sides near top 30 are glued together and have a drawstring embedded in one of them so that when it is pulled, the top is slit open to expose the bag contents. Such opening mechanism is conventional and need not be discussed further.

Tape 16 includes a film backing with first and second adhesives 32 and 34 on back and front sides 36 and 38, respectively. First adhesive 32 has the characteristic of adhering or bonding to both front 24 of enclosure 12 and to the film backing.

A liner 40 covers second adhesive 34. Liner 40 protects second adhesive 34 before bag 10 is opened and is stripped from second adhesive 34 after bag 10 is opened and just before bag 10 is resealed. Second adhesive 34 has the characteristic in tension of delaminating from liner 40 prior to delaminating from the film backing of tape 16 and also of delaminating from the defined release surface 48 of strip 18, discussed hereinafter, before delaminating from the film backing of tape 16.

Strip 18 includes a third adhesive 42 on a back side 44 which bonds both to back side 44 of strip 18 and back 26 of enclosure 12. The front side 46 of strip 18 forms a defined release surface 48. Defined release surface 48 provides a desired controlled or preselected adhesion release surface. The defined release surface of the present invention provides an element which allows closure with a pressure sensitive adhesive thereby isolating the adhesive and the defined release surface as a closure system which can be designed separate from the bag and then applied as appropriate at particular locations on the bag. Exemplary strips 18 may be found in U.S. Pat. No. 2,532,011 and in U.S. Pat. No. 2,607,711, both of which are hereby incorporated by reference.

Figure 2:
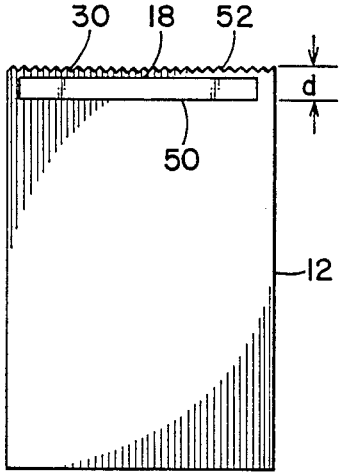
FIG. 2 is a plan view of the backside of the bag of FIG. 1.
Figure 3:
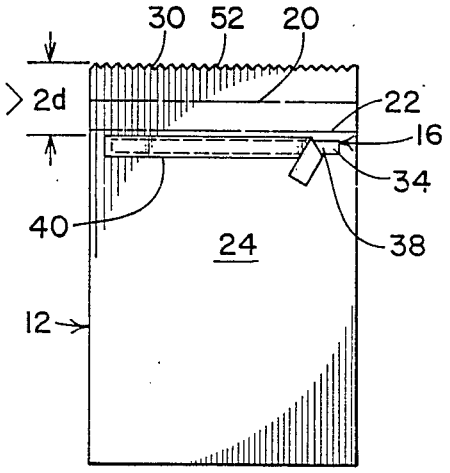
FIG. 3 is a plan view of the front side of the bag of FIG. 1.

The top portion of enclosure 12 is foldable so that the defined release surface 48 can be moved into contact with second adhesive 38 of tape 16. More particularly, as shown in FIGS. 2 and 3 tape 16 is attached to enclosure 12 at a first receiving location and strip 18 is attached to enclosure 12 at a second receiving location. Strip 18 at the second receiving location extends transversely and has a bottom edge 50 spaced a distance d from top edge 52 of the top of enclosure 12. Tape 16 at the first receiving location extends transversely and is spaced at least a distance *2d* from top edge 52. In this way, the top portion of enclosure 12 may be folded at lines 20 and 22 and defined release surface 46 will readily align with second adhesive 34 on the front side 38 of tape 16. In this regard, since the defined release surface of strip 16 is essentially a target for the second adhesive, it is preferred that strip 18 be longer and wider than tape 16. Preferably, neither tape 16 nor strip 18 extends to the side edges of enclosure 12 so that neither is inadvertently stripped from enclosure 12.

With such closure configuration, the first and third adhesives form a stronger bond with enclosure 12 and with the film backing of tape 16 and with the backing of strip 18, respectively, than the bond the second adhesive forms with surface 48. This is necessary so that tape 16 will remain adhered to front 24 and strip 18 will remain adhered to back 26 when the defined release surface 48 is separated from the second adhesive. At the same time, the second adhesive has the further characteristic that in tension it delaminates from the defined release surface 48 before delaminating from the tape backing so that it remains on the tape backing after the defined release surface and the tape are separated.

Figure 4:
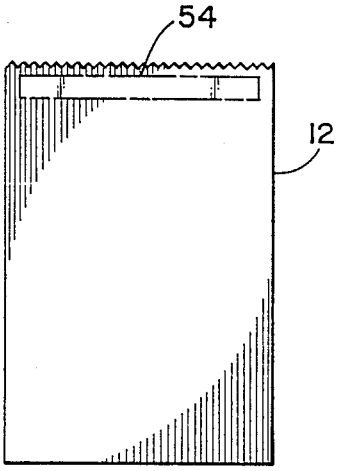
FIG. 4 is a plan view of an alternate embodiment of the backside of a bag having a front side as shown in FIG. 3.

Alternately, as shown in FIG. 4, a defined release surface 54 using a predetermined material of a type indicated hereinbefore may be coated or applied directly on enclosure 12. In this case, strip 18 is not present and rather the surface 54 is formed by the material.

Figure 5:
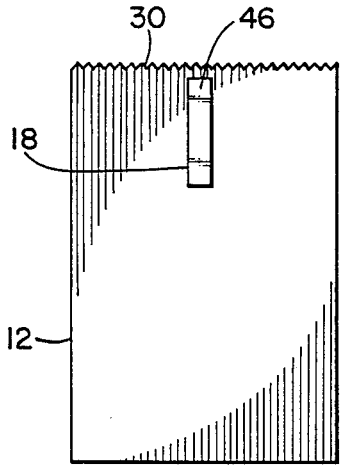
FIG. 5 is a further alternate embodiment of a backside of a bag in accordance with the present invention.
Figure 6:
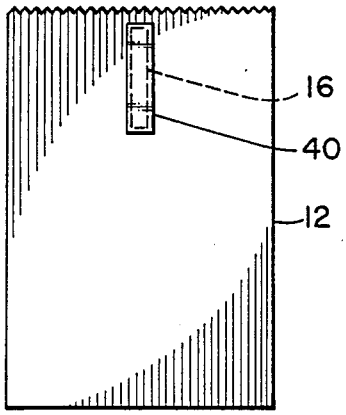
FIG. 6 is an alternate embodiment of a front side of the bag of FIG. 5.

As shown in FIGS. 5 and 6, tape 16 with liner 40 in some circumstances may be applied longitudinally on enclosure 12, while strip 18 is at the same time applied longitudinally on the opposite side. With this type of closure system, the top 30 is rolled so that defined release surface 46 contacts the second adhesive on tape 16.

Figure 7:
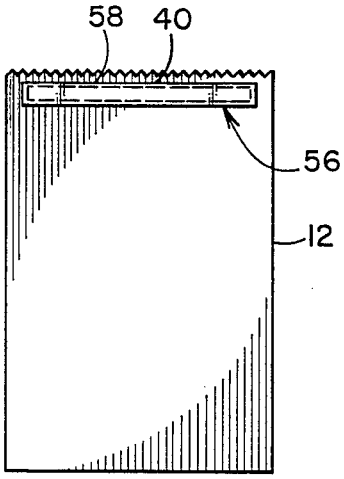
FIG. 7 is a plan view of a backside of still a further alternate embodiment.
Figure 8:
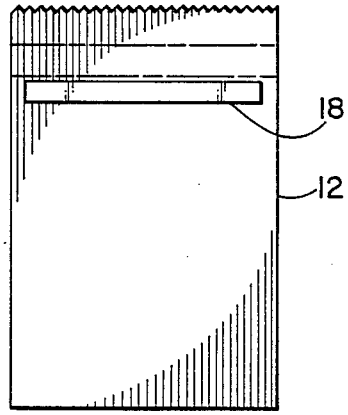
FIG. 8 is a front side of the bag of FIG. 7.

Although the pressure-sensitive adhesive is preferably located on the front of bag 10, as shown in FIGS. 7 and 8, it may be interchanged with the defined release surface with respect to the receiving locations. As further shown in FIG. 7, the pressure sensitive adhesive need not necessarily be the exposed adhesive of a double coated tape. Rather, an adhesive transfer tape 56 can be applied to the proper location on enclosure 12. When it is desired to reseal the opened enclosure, the tape liner 58 is removed and since the adhesive forms a better bond with the enclosure material than it does with the liner, the adhesive remains on the enclosure. Alternately, the pressure-sensitive adhesive could be coated or applied directly on the enclosure 12 at the appropriate location and a protective liner provided until resealing is desired.

Figure 9:
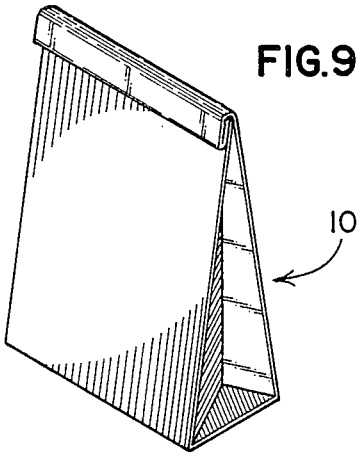
FIG. 9 is a perspective view of a resealed bag in accordance with the preferred embodiment.

In use, opening mechanism 14 is functioned to open bag 10 and expose its contents. Liner 40 is removed from the pressure sensitive adhesive. The top of bag 10 is then folded at lines 20 and 22 so that the exposed defined release surface 46 comes into contact with the adhesive thereby resealing bag 10 as shown in FIG. 9. The bag is reopened simply by unfolding the top portion so that surface 46 separates from the adhesive.

The present invention was used on a bag typically filled with a charcoal product. The bag was a web bottom, flush cut, gussetted, heat sealable, inner lined, two ply, multi-wall paper bag structure flexigraphically printed with an overcoat varnish. The strip 18 was a single sided tape with low adhesion coating on the opposite side of type Y-8470 available from 3M Company, Packaging Systems Division, 3M Center, St. Paul, MN 55144. A first example of a pressure sensitive adhesive was a double coated tape of type 443, and a second example was a transfer tape of type 752, both of which are available from the above indicated source.

As indicated, the present invention is particularly advantageous in that the resealing closure system is substantially independent from the material and condition of the bag. That is, with a tape system once it is established that the first and third adhesives must have a greater bonding to the bag than the second adhesive has to the control release surface, the condition of the bag is of no further importance to the closure system. At that point, the bonding strength of the second adhesive relative to the defined release surface can be selected based on considerations like the unfolding force of the bag due to its memory, any separating force due to the contents within the bag, the desired force for unsealing the resealed bag, etc. The closure system need not be designed for a wide variety of paper materials, smoothness of surfaces, cleanliness of surfaces, etc. Furthermore, the indicated size of the defined release surface provides an appropriate target, while the scored lines provide a mechanism for bringing the target into close alignment with the second adhesive.

Thus, preferred and alternate embodiments of the present invention have been described and discussed in detail. It is understood, however, that equivalents are possible. In this regard, changes made from the disclosure as presented, especially in matters of shape, size and arrangement of parts to the full extent extended by the general meaning of the terms in which the appended claims are expressed, are understood to be within the principle of the invention.

What is claimed is:

1. A releasable bag holding product contents, comprising:

an enclosure for holding the product contents having a top portion and opposite flat sides forming a front and a back, said enclosure including means for opening said top portion, said enclosure having first receiving location on the front and a second receiving location on the back;

means for providing a pressure-sensitive adhesive coating at one of said first and second receiving locations;

means for forming a defined release surface at the other of said first and second receiving locations;

said enclosure being foldable so that said surface forming means contacts said adhesive coating providing means, said adhesive coating providing means bonding both said enclosure and the surface forming means and in tension delaminating from the surface forming means before delaminating from the enclosure such that the adhesive coating providing means remains on the enclosure when the surface forming means separates from the adhesive coating providing means; and a release liner covering the adhesive coating such that said adhesive coating providing means has the further characteristic in tension of delaminating from said liner prior to delaminating from said enclosure;

whereby when said enclosure is opened at said opening means and said liner is stripped from said adhesive coating, said enclosure can be closed by folding said enclosure to bring said surface forming means and said adhesive coating into contact with one another.

2. The bag in accordance with claim 1 wherein said pressure-sensitive adhesive providing means includes a double coated tape having first and second pressure-sensitive adhesives on first and second sides, respectively, of a film backing said first side of said tape adhering to said enclosure, said second side of said tape adhering to said surface forming means when said surface forming means is brought into contact with said second adhesive, said first and second adhesives forming a stronger bond with said film backing than and said first adhesive forming a stronger bond with said enclosure than the bond said second adhesive forms with said surface forming means so that said second adhesive releases said surface forming means before said tape separates from said enclosure.

3. The bag in accordance with claim 1 wherein said pressure-sensitive adhesive providing means includes an adhesive transfer tape, said adhesive transfer tape having a backing liner with an adhesive bonded thereto, said adhesive bonding more strongly with said enclosure than with said backing liner so that said backing liner may be removed thereby leaving said adhesive adhered to said enclosure.

4. The bag in accordance with claim 1 wherein said surface forming means includes a strip having third and fourth sides and a third adhesive with a characteristic of bonding to both the third side of said strip and the second receiving location on the back of said enclosure, said fourth side forming said defined release surface.

5. The bag in accordance with claim 4 wherein said second receiving location extends transversely and has a bottom edge spaced a distance d from a top enclosure edge at the top of said enclosure and wherein said first receiving location extends transversely and is spaced more than **2*d*** from the top enclosure edge.

6. The bag in accordance with claim 5 further including at least two scored transverse lines in the front of said enclosure between said tape and said enclosure top edge which encourage folds at said lines so that said defined release surface and said adhesive coating generally align with one another after at least two folds.

7. The bag in accordance with claim 4 wherein said strip extends longitudinally of said bag.

8. The bag in accordance with claim 7 wherein said adhesive coating extends longitudinally of said bag.

9. The bag in accordance with claim 4 wherein said strip is longer and wider than said adhesive coating.

10. The bag in accordance with claim 1 wherein said surface forming means includes a material printed on the other of said first and second receiving locations.

11. A resealable bag, comprising:

an enclosure for holding product contents having a top portion with a top edge and opposite flat sides forming a front and a back, said enclosure including means for opening said top portion;

a tape having first and second pressure-sensitive adhesives on first and second sides of a backing, respectively, said first side of said tape adhering to said front of said enclosure;

a strip having a third adhesive sticking to the back of said enclosure, said strip having an exposed surface forming a defined release surface, said strip being wider and longer than said tape, said strip extending transversely and having a bottom edge spaced a distance d from the top enclosure edge, said tape also extending transversely and being spaced more than **2*d*** from the top enclosure edge;

two scored transverse lines in the front of said enclosure between said tape and said enclosure top edge which encourage folds at said lines so that said defined release surface of said strip and said second adhesive of said tape generally align with one another after at least two folds of the top of said enclosure; and said first and third adhesives having a stronger bond to said enclosure than said second adhesive has to said defined release surface, said second adhesive bonding to both said tape backing and said defined release surface and in tension releasing the defined release surface before releasing the tape backing.

* * * * *

UNITED STATES PATENT AND TRADEMARK OFFICE

CERTIFICATE OF CORRECTION

PATENT NO. : 4,871,265

DATED : October 3, 1989

INVENTOR(S) : James M. Peck

It is certified that error appears in the above-identified patent and that said Letters Patent is hereby corrected as shown below:

Column 5, line 13, "releasable" should be--resealable--.

Column 5, line 50, after "backing" insert a comma.

Signed and Sealed this

Eighteenth Day of December, 1990

*Attest:*

HARRY F. MANBECK, JR.

*Attesting Officer*

*Commissioner of Patents and Trademarks*